United States Patent [19]

Guttman

[11] 4,323,104

[45] Apr. 6, 1982

[54] PROTECTIVE MEANS FOR DOOR AND WINDOW OPENINGS

[76] Inventor: Milton Guttman, 1719 Miami Gardens Dr., N. Miami Beach, Fla. 33162

[21] Appl. No.: 124,769

[22] Filed: Feb. 26, 1980

Related U.S. Application Data

[63] Continuation of Ser. No. 663,215, Mar. 2, 1976, abandoned, which is a continuation-in-part of Ser. No. 466,798, May 3, 1974, abandoned.

[51] Int. Cl.[3] ..... E06B 3/30; E06B 3/36

[52] U.S. Cl. ..... 160/92; 49/64

[58] Field of Search ..... 49/51, 56, 64, 61, 57, 49/50, 81, 84, 87, 463, 464; 160/90, 91, 92, 37

[56] References Cited

U.S. PATENT DOCUMENTS

| | | | |
|---|---|---|---|
| 1,806,637 | 5/1931 | McGavic | 49/61 |
| 2,804,182 | 8/1957 | Roos | 49/51 |
| 2,878,667 | 3/1959 | Jones | 49/64 X |
| 2,902,728 | 9/1959 | Nardulli | 49/64 |
| 2,904,854 | 9/1959 | Adamson | 49/64 X |
| 3,083,419 | 4/1963 | Pennington et al. | 160/90 X |
| 3,160,927 | 12/1964 | Busillo | 49/57 |
| 3,381,416 | 5/1968 | Torres et al. | 49/464 |
| 3,534,800 | 10/1970 | Guttman | 160/92 |
| 3,837,118 | 9/1974 | Goss et al. | 49/61 |

*Primary Examiner*—Philip C. Kannan

*Attorney, Agent, or Firm*—Finnegan, Henderson, Farabow, Garrett & Dunner

[57] ABSTRACT

Doors and windows of the louver type are protected against unauthorized entry and against severe storm conditions by having a channeled frame member positioned interiorly of the door or window aperture, a solid panel received within said channeled frame member and adjustable lock means to lock the solid panel in the frame member from the interior side.

5 Claims, 11 Drawing Figures

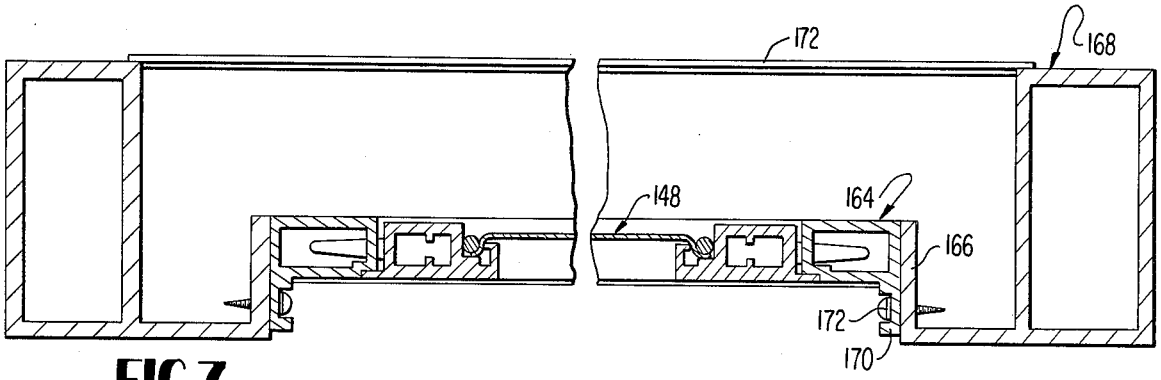
FIG. 7
FIG. 8
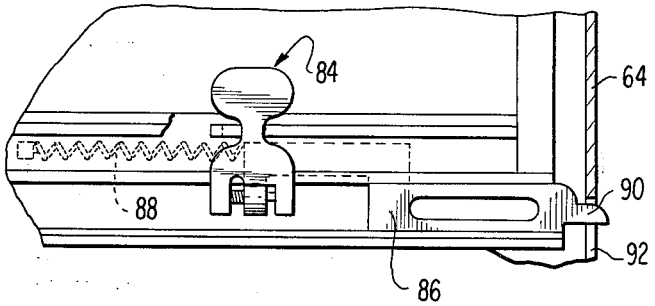
FIG. 9
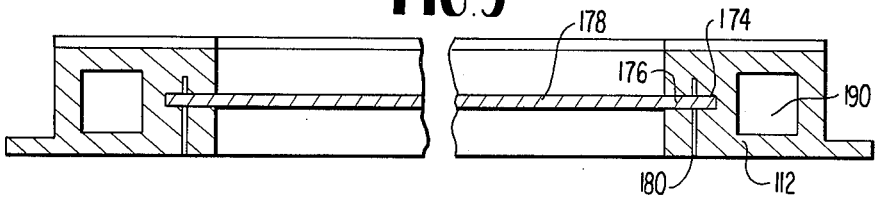
FIG. 10
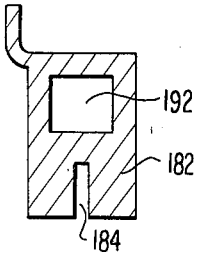
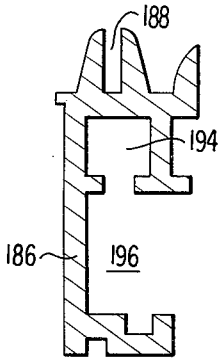
FIG. 11

PROTECTIVE MEANS FOR DOOR AND WINDOW OPENINGS

CROSS-REFERENCE TO RELATED APPLICATION

This is a continuation of U.S. application Ser. No. 663,215, filed Mar. 2, 1976, now abandoned which is a continuation-in-part of my copending application Ser. No., 466,798, filed May 3, 1974, now abandoned.

BACKGROUND OF THE INVENTION

1. Field of the Invention

This invention relates to dwelling security devices. More particularly, it relates to means to prevent unauthorized entry through a window or door opening of a building and also protection against severe storm conditions. Additionally, it concerns channeled frame structures for louvered window units to accomodate a so-called Intruder Sash.

2. Description of the Prior Art

Windows and doors having louver or jalousie type closures for the apertures therein are extensively used in building construction, particularly for dwellings situated in warm climates. Such windows or doors may be of the narrow louver type (see U.S. Pat. No. 2,954,590) or the wider panel type, generally referred to as awning type (see U.S. Pat. Nos. 3,070,853 and 3,071,219). This invention is applicable to all louver-type windows and doors, but is particularly applicable to the awning type.

Louver-type building openings have been developed to include removable screens (see U.S. Pat. No. 2,813,314) and storm panels, some being provided with storage compartments for the screens and storm panels (see U.S. Pat. No. 3,534,800). Storage of window units within the building structure when not in position across the window aperture is also known in connection with windows other than the louver-type (see U.S. Pat. Nos. 2,088,866 and 2,319,245).

Louver-type windows and doors are quite vulnerable to unauthorized entry by intruders. They are also vulnerable to severe storm conditions. Hence, there is a need for means to reduce this vulnerability and protect such windows and doors against intruders and storms. The problem of protecting windows against entry by intruders is, of course, not limited to louver-type windows and removeable guard units have been developed for use with other type windows (see U.S. Pat. Nos. 1,438,202; 2,050,322 and 3,160,927).

There also exists the need to terminate the need of present day means of the use of attachable full length screens, the only means provided for protection of the louver window opening against the elements and unauthorized entry and which requires skill and costly man hours for window cleaning.

OBJECTS

A principle object of this invention is the provision of means to protect louver-type windows and doors against intruders and storms.

A further object is the provision of frame structures and accessories for louver-type windows and doors that require structural demolition, occupant and/or neighbor awareness and time delay for unauthorized entry.

Another object is the provision of a permanent embodied mountable sash unit for protection against unauthorized entry.

A further object is the elimination of the use of attachable full-length screens to the louvered window unit that require the use of numerous screws, clamps and unwarranted costly man hours for window cleaning.

An additional object is to eliminate damage to shades due to contact with the full length screen.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY Of THE INVENTION

The objects are accomplished according to the invention by providing moveable louver type window or door apertures that include top, bottom and side frame members defining the opening and that have a plurality of horizontal glass panels pivotally mounted upon the side frame members to swing upwardly and exteriorly of the opening from a position closing the opening with protection means comprising a rectangular channeled frame member positioned interiorly of said glass panels, a solid panel received within said channeled frame member, the solid panel being of a size that completely covers said opening, and adjustable lock means to lock said solid panel in said channeled frame member from the interior side of said opening.

BRIEF DESCRIPTION OF THE DRAWINGS

A more complete understanding of the invention can be obtained by reference to the accompanying drawings in which:

FIG. 7 is a fragmentary horizontal top view of a window protective means of the invention illustrated as installed in the aperature of a louvre window.

FIG. 8 is a fragmentary plan view of adjustable lock means for an intruder sash of the invention.

FIG. 9 is a fragmentary horizontal sectional bottom view of an intruder sash of the invention.

FIG. 10 is a sectional view of an upper horizontal frame section for the intruder sash of FIG. 9.

FIG. 11 is a sectional view of a lower horizontal frame section for the intruder sash of FIG. 9.

DESCRIPTION OF THE PREFERRED EMBODIMENTS

Figure 1:
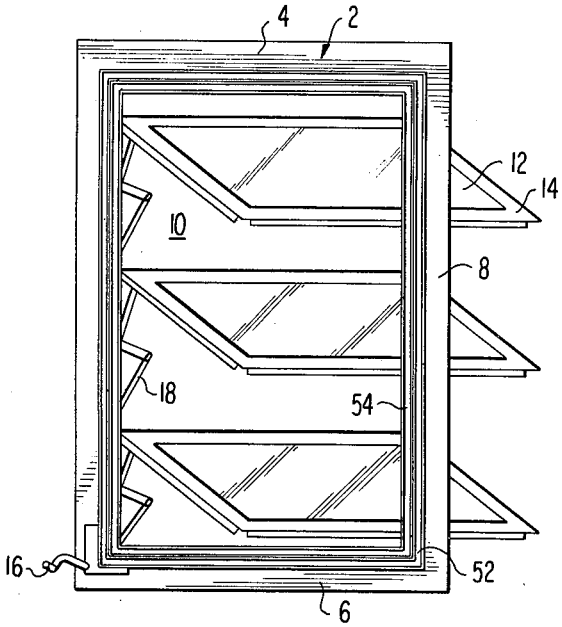
FIG. 1 is an isometeric view of an awning-type louvre window unit of the invention with the intruder sash removed.

Referring in detail to the drawings in which identical parts are numbered alike, the moveable louvre type window 2 comprises top, bottom and side frame members 4, 6 and 8 respectively that define an exterior window opening 10. The window 2 also comprises an interior window-aperture 10A which is smaller in width and height than the opening 10. The difference in width and height between the opening 10 and the window-aperture 10A provides a space 11 within the frame members rearwardly of the window opening 10.

A plurality of rectangular horizontal glass panels 12 are carried by frame units 14 pivotally mounted to swing upwardly and exteriorly of the window opening 10 from a position closing the opening.

Operation of the panels 12 between an open and closed position is controlled by crank member 16, and linkages 18, and drive shaft 20. The mode of operation of such awning-type louvre windows is well known and need not be described in detail. The details of the louvre operators is omitted from FIGS. 2 and 3 as being unnecessary to the description of the invention.

The protection means of the invention comprises a pair of rectangular intruder sash 30 positioned interiorly of the glass panels 31 shown in a closed position. Solid security panels 32 are received in top, side and bottom channels 34, 36 and 38 respectively of frame member 30.

Figure 2:
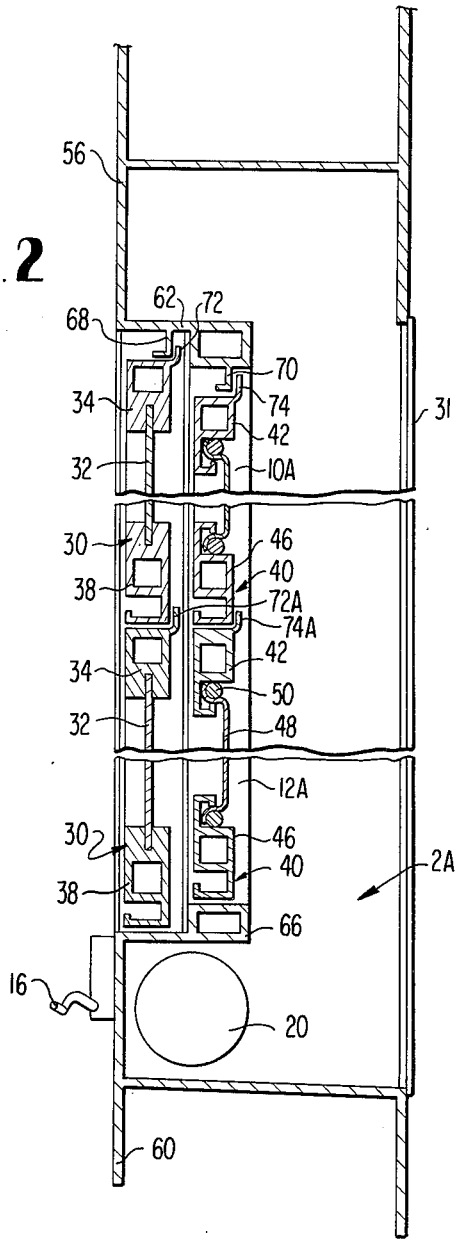
FIG. 2 is a vertical fragmentary sectional side view of a window unit such as shown in FIG. 1 (omitting detailing of louvre portions for the purpose of clarity).
Figure 3:
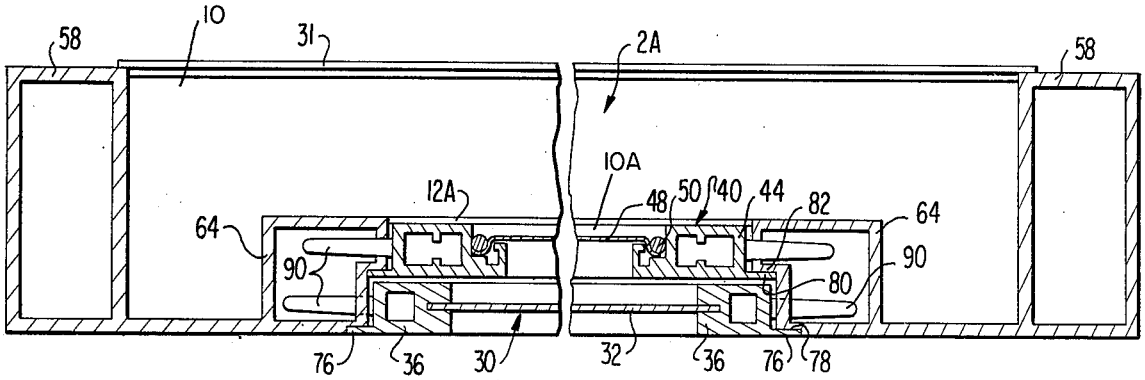
FIG. 3 is a horizontal fragmentary sectional top view of the window unit shown in FIG. 2.

The window aperature 10A is also provided as shown in FIGS. 2 and 3 with screens 40. These comprise top, side and bottom channels 42, 44 and 46 respectively across which the screen 48 is stretched and held in position by the spline 50.

The intruder sash 30 and screens 40 are shown removed in FIG. 1 for the purpose of illustration. The sash 30 would be received in recess 52 formed in frame members 4–8 and screens 40 would be received in recess 54. The window unit 2 is of modular construction designed for installation in any suitable wall structure in accordance with established building construction practice.

The window 2A (FIGS. 2 and 3) comprises the top, side and bottom frame members 56, 58 and 60 respectively. The aperature 10A is defined by upper, side and lower channeled members 62, 64 and 66 which extend from the rear of the window 2A perpendicularly of the plane of the intruder sash 30 and screens 40 toward the glass panes 31.

The upper channeled member 62 carries shoulders 68 and 70 which hook the flanges 72 and 74 of channel members 34 and 42 respectively to help hold the top sash 30 and top screen 40 in operative position. The corresponding flanges 72A and 74A on the bottom sash 30 and bottom screen 40 are similarly hooked in position by the bottom frames 38 and 46 of the top sash and screen.

The side frames 36 of intruder sash 30 carry flanges 76 which are received in the recesses 78 of the side channeled members 64. Similarly, the side frames 44 of screens 40 carry flanges 80 that bear against shoulders 82 on the side channeled members 64.

Lock means 84 to lock the intruder sash 30 and screens 40 in place in the aperature 10A comprise right and left hand units. The right hand unit shown in FIG. 8 has sliding bolt member 86, spring 88 and latch element 90. The lock means 84 is described in more detail in my prior U.S. Pat. No. 3,534,800, the disclosure of which is incorporated herein by reference as to the description of the lock means and any other elements described therein common to the devices of this present invention. Other forms of lock means for window panels that may be operated from the interior side of a window are known and may be used in my aperature protection devices.

In the installation of the intruder sash 30 in the aperature 12A, the latch element 90 enters an opening 92 in the side frame member 64 to fix the security panel 32 in aperature protection position. The screen 40 is similarly locked in operative position with its latch means 84.

Figure 4:
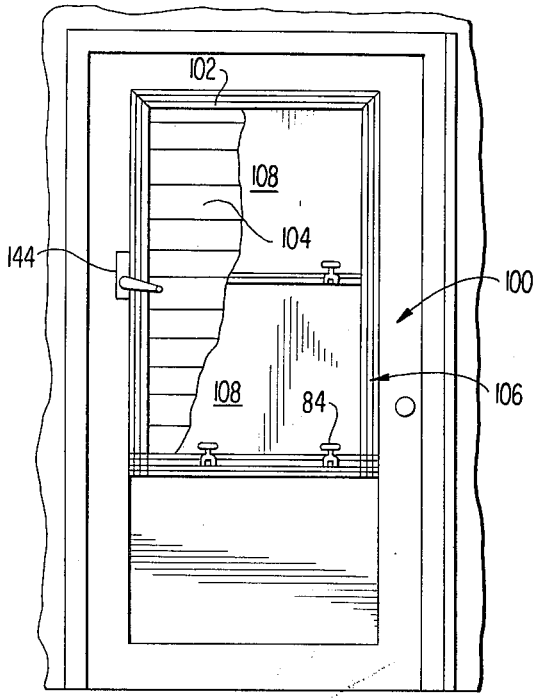
FIG. 4 is a fragmentary plan view of a louvre door provided with protective means of the invention.

In a modification of the invention, my new protective means may be used for the aperture of a louvre type door as shown in FIG. 4. The door 100 has the rectangular aperture 102 and a plurality of rectangular horizontal moveable glass louvre panels 104 pivotally mounted in the aperture to swing upwardly and exteriorly of the door. The door opening also comprises a rectangular louvre unit 106. Positioned interiorly of the louvre panels 104 within the unit 106 is a pair of solid security panels 108. Adjustable lock means 84 fixes the security panels 108 in the unit 106 from the interior side of the door.

Figure 5:
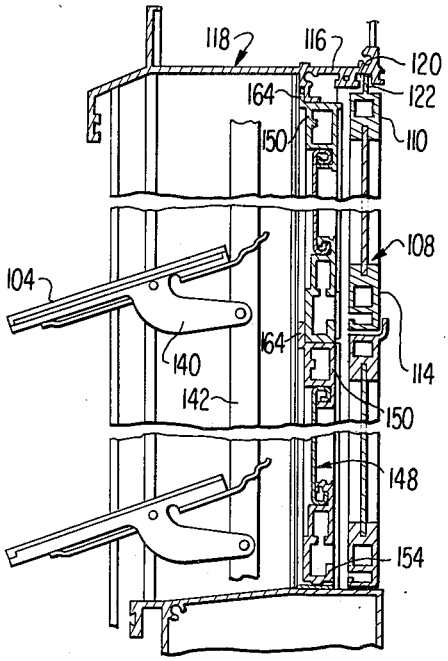
FIG. 5 is an enlarged vertical fragmentary sectional side view of the top portion of a door as shown in FIG. 4.

FIG. 5 illustrates a louvred door having a security panel or intruder sash 108 in accordance with the invention. The sash 108 comprises top, side and bottom frame members 110, 112 and 114 respectively. The top channeled member 116 of the door frame 118 has a horizontal recess 120 that receives flange 122 of top frame member 110 for retention of the security panel 108.

The louvre unit 124 of the door comprises a vertical frame structure 126 integral with vertical channeled member 128 and channel unit 130 to receive retaining strip 132 by which the unit 124 may be fixed in a door aperture 102 using screws 134 or other suitable fasteners.

The unit 124 includes the flange 136 upon which are pivotally supported the frames 138 that hold the glass panes 104. The louvres are opened or closed by movement of the arm 140 through linkage 142 that connects to the crank mechanism 144.

The side frame members 112 of the intruder sash 108 have flanges 144 that are received in recesses 146 of the channeled member 128. Hence, the sash 108 can be firmly locked in position by action of latch elements 90, flanges 122 and 144.

The screen 148 comprises top, side and bottom frame members 150, 152 and 154 respectively, wire cloth 156 and spline 158. The side frame members 152 carry flanges 160 that fit into recesses 162 in the channeled members 128. Also, top frame members 150 have flanges 164 which cooperate with latch elements 90 to fix the screens in position in the door aperture 102.

Each intruder sash 108 and screens 148 in the respective pair may be identical in vertical height or may be different in height. Of course, the intruder sash and screens may be used together or separately, e.g., normal daytime operation will use the screens without the intruder sash while nightime operation will use the intruder sash also.

Figure 6:
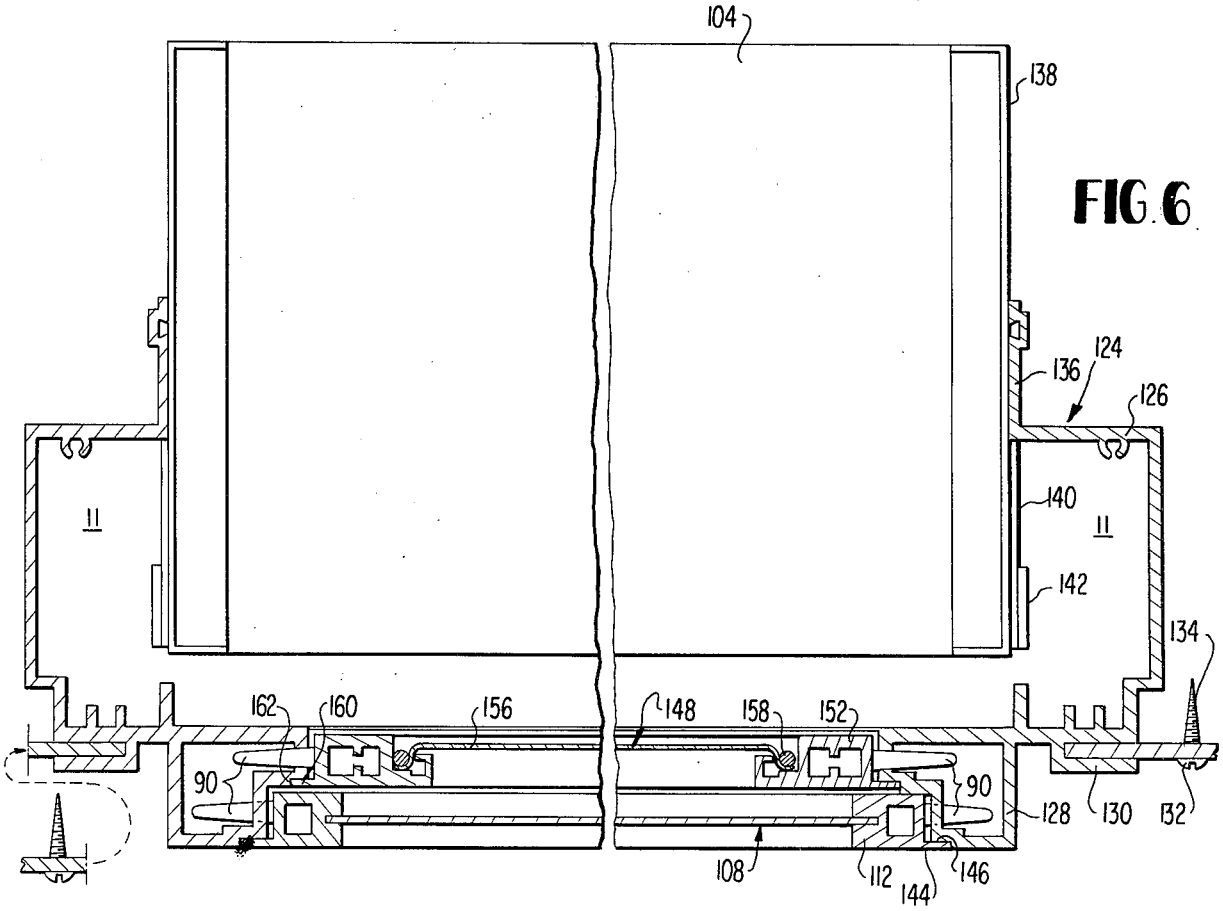
FIG. 6 is an enlarged horizontal fragmentary sectional top view of a louvre unit of the invention for a door.

FIG. 7 illustrates an embodiment of the invention for use with an awning type louver window previously installed in building. The screen 148 is structured as described relative to FIGS. 4–6. Intruder sash (not shown in FIG. 7) would also be structured as described for FIGS. 4–6 and can be interchangeable with the screen. A channeled rectangular frame 164 consisting of top, side and bottom members is sized to fit snugly into the window aperture defined by the flanges 166 of the window unit 168. The frame 164 is fixed in the aperture by means of lugs 170 and screws 172 or other suitable fasteners. Alternatively the attachable frames can be made with two channels, one for the screens and the other for the security sash. The glass louvers 172 are illustrated as in closed position. The louver operating mechanism is not illustrated for the purpose of clarity and can be of any suitable type.

FIG. 9 shows more details of intruder sash of the invention. The channeled side frame members 112 comprise slots 174 that receive the edges 176 of the solid panel 178. Pins 180 serve to fix the panel 178 in place. The top frame member 182 also has a slot 184 also to receive an edge of the panel 178. Similarly, bottom frame member 186 has slot 188 to receive a bottom edge of the panel. A rectangular frame is formed from the members 112, 182 and 186 by means of angle pieces (not shown) that fit into the channels 190, 192 and 194 in a manner known in the art. The area 196 of the member 186 is formed to accomodate a latch device such as shown in FIG. 8.

The various frame members of the intruder sash or screens are advantageously formed of extruded metal, e.g., aluminum. Alternatively, they may be extruded or molded of plastics. The solid panels of the intruder sash may be formed of metal, e.g., steel or aluminum, reinforced plastics or the like.

The window opening protection means of this invention can be seen from the foregoing description, to be of simple construction and, hence, so inexpensive as to be available to most any dwelling requiring protection against unauthorized entry. To date the only protection for a louvre window unit is a full length screen. There has been no offering of protection against unauthorized entry by any window unit that would demand structural demolition for entry. As a means to provide protection against entry, I have developed a formidable frame structure for the louvred window unit for assisting in providing such protection. I developed a louvre-mountable sash frame structure which accepts both louvres and mountable sash within its own aperture and, in so doing, I terminate the need to use the present day's only protection for the louvre window unit, eliminating inconvenience and cost of lengthy man hours required for window cleaning. As means for completing the needs for protection against unauthorized entry, I have developed an intruder sash which has a frame structure that fully accepts a metal enclosure panel during assembly which, after assembly, are pinned together or otherwise embodied for permanent togetherness. When the louvre-mountable frame and the intruder sash are operated together, they provide protection against unauthorized entry through the aperture of the window unit, demanding structural frame demolition, creating occupant and neighbor awareness and produce time delay for such intrusion enabling remedial action by dwelling occupant and neighbors.

The embodiments of the invention in which an exclusive property or privilege is claimed are defined as follows:

1. Apparatus for providing protection against unauthorized entry through a movable louver window of the awning type having a plurality of rectangular window panels pivotally carried at their upper ends by linkage means for swinging upwardly and exteriorly of the window, the panels and linkage means being supported and at least partially surrounded by a window frame, comprising:

a separate support frame supported by, and secured wholly within the confines of, said window frame and situated laterally adjacent at least a portion of said linkage means, said support frame having adjoining top, bottom, and side frame members and having exterior dimensions sufficiently small to avoid interference with the movement of said panels and said linkage means during their operation;

at least one substantially intrusion-proof sash having a security panel secured therein, said sash being supported within said support frame; and lock means for locking said sash within said support frame from the interior side of said window, said lock means comprising at least one slot in at least one of the side frame members of said support frame and a latch element secured to said sash for sliding through said slot, said at least one side frame member having a receptacle surrounding the portion of said latch element extending through said slot when said sash is locked within said support frame.

2. Apparatus as claimed in claim 1, wherein said support frame comprises a modular unit secured in a preexisting window frame.

3. Apparatus as claimed in claim 1, wherein said support frame is integral with the window frame.

4. Apparatus as claimed in claim 1, wherein two of said sashes are received in tandem within said support frame.

5. Apparatus as claimed in claim 1, further comprising at least one rectangular screen unit received within said support frame exterior of said sash, said screen unit having lock means for locking said screen unit within said support frame from the interior side of said window, said lock means comprising at least one opening in at least one of the side frame members of said support frame and a latch member secured to said screen unit for sliding through said opening, said at least one side frame member having a receptacle surrounding the portion of said latch member extending through said opening when said screen unit is locked within said support frame.

* * * * *